US006719573B2

(12) United States Patent
Koehler et al.

(10) Patent No.: US 6,719,573 B2
(45) Date of Patent: Apr. 13, 2004

(54) ELECTRICAL CONNECTOR ASSEMBLY AND METHOD OF ASSEMBLING SAME

(75) Inventors: David F. Koehler, Lake Orion, MI (US); Jeffrey S. Campbell, West Bloomfield, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/100,249

(22) Filed: Mar. 18, 2002

(65) Prior Publication Data

US 2003/0199182 A1 Oct. 23, 2003

(51) Int. Cl.[7] ..... H01R 12/00

(52) U.S. Cl. ..... 439/79; 439/733.1; 439/744; 439/751; 439/541.5; 29/837

(58) Field of Search ..... 439/79, 541.5, 439/751, 733.1, 743, 744; 29/837

(56) References Cited

U.S. PATENT DOCUMENTS 5,453,016 A * 9/1995 Clark et al. ..... 439/79
5,540,598 A * 7/1996 Davis ..... 439/79
5,639,249 A * 6/1997 Lenoir ..... 439/79
5,639,251 A * 6/1997 Harting et al. ..... 439/79
5,743,765 A * 4/1998 Andrews et al. ..... 439/608
5,971,774 A * 10/1999 Kuki et al. ..... 439/79
6,210,180 B1 * 4/2001 Lee et al. ..... 439/79
6,491,536 B1 * 12/2002 Torii ..... 439/246

* cited by examiner

*Primary Examiner*—Truc Nguyen
(74) *Attorney, Agent, or Firm*—Stacey E. Caldwell

(57) ABSTRACT

A plurality of terminals are assembled in a housing of an electrical connector with pin portions of the terminals projecting from the housing. The pin portions are inserted in an insertion direction in a plurality of free passages in a support member from one side thereof until retention portions of the terminals pass retention sections of a plurality of retention passages in the support member. The pin portions are moved transversely of the insertion direction through a plurality of communication openings in the support member from the free passages, into the retention passages and into alignment with the retention sections in the retention passages in the support member.

29 Claims, 7 Drawing Sheets

FIG. 2a
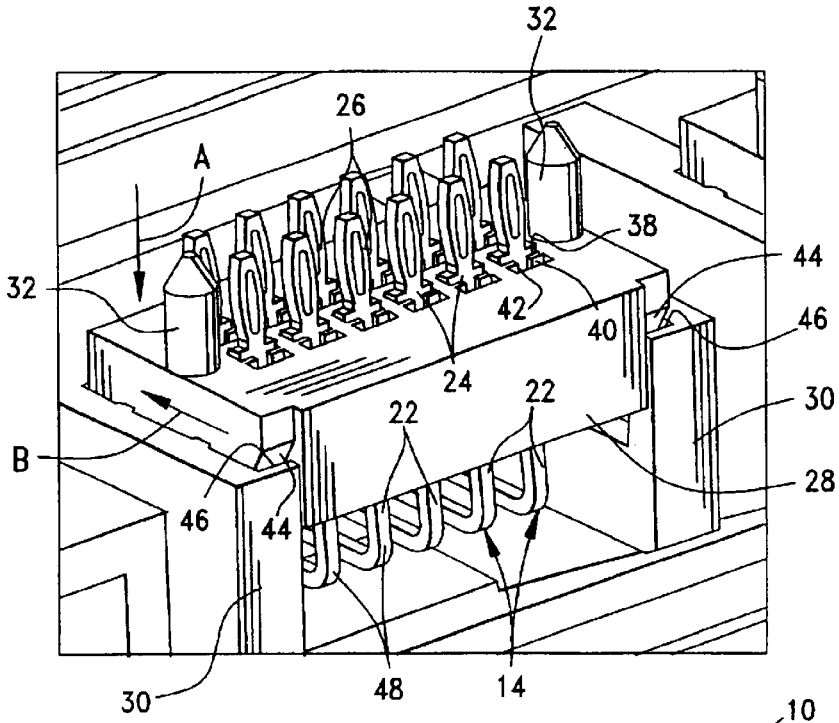
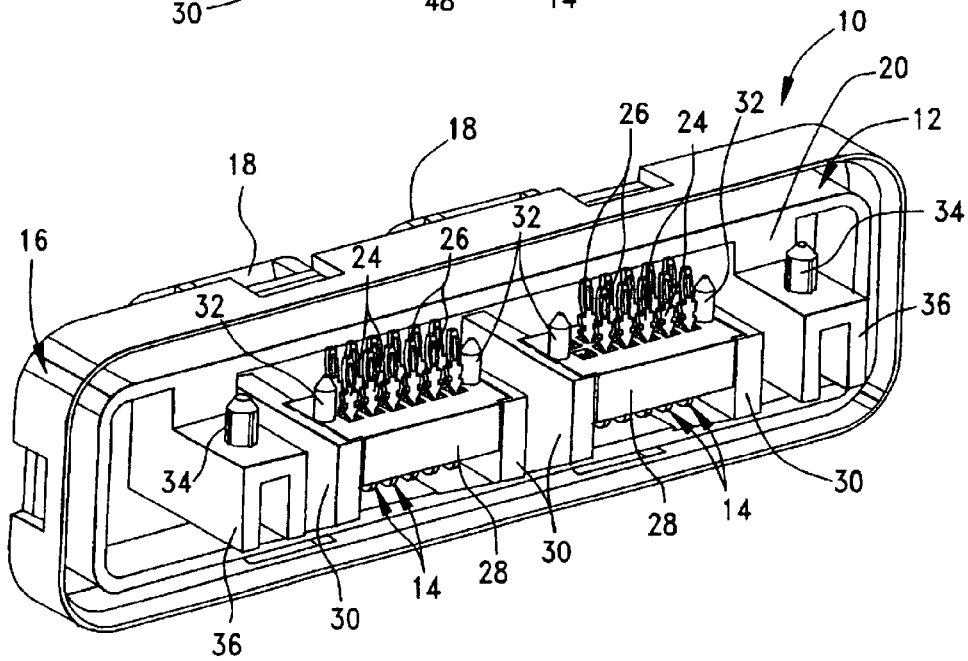
FIG. 3

FIG. 3a
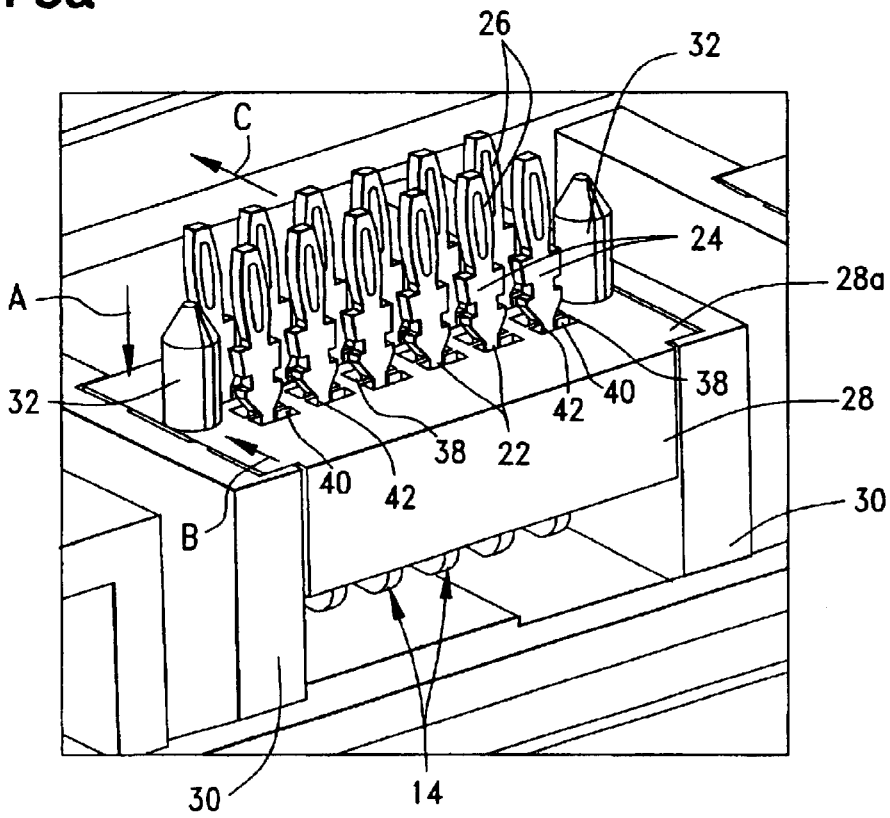
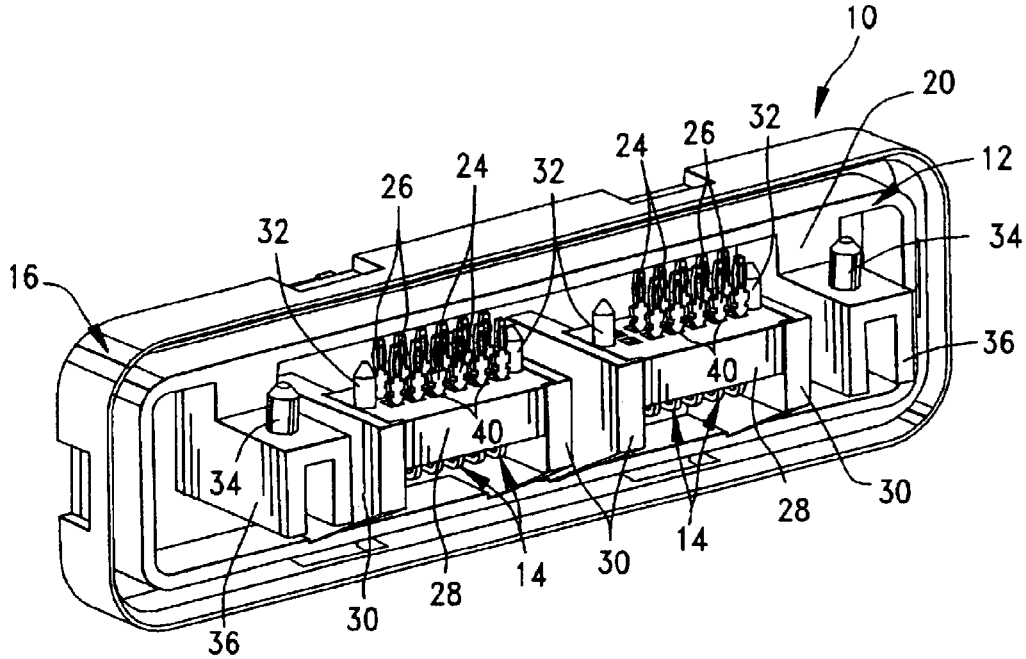
FIG. 4

FIG. 4a
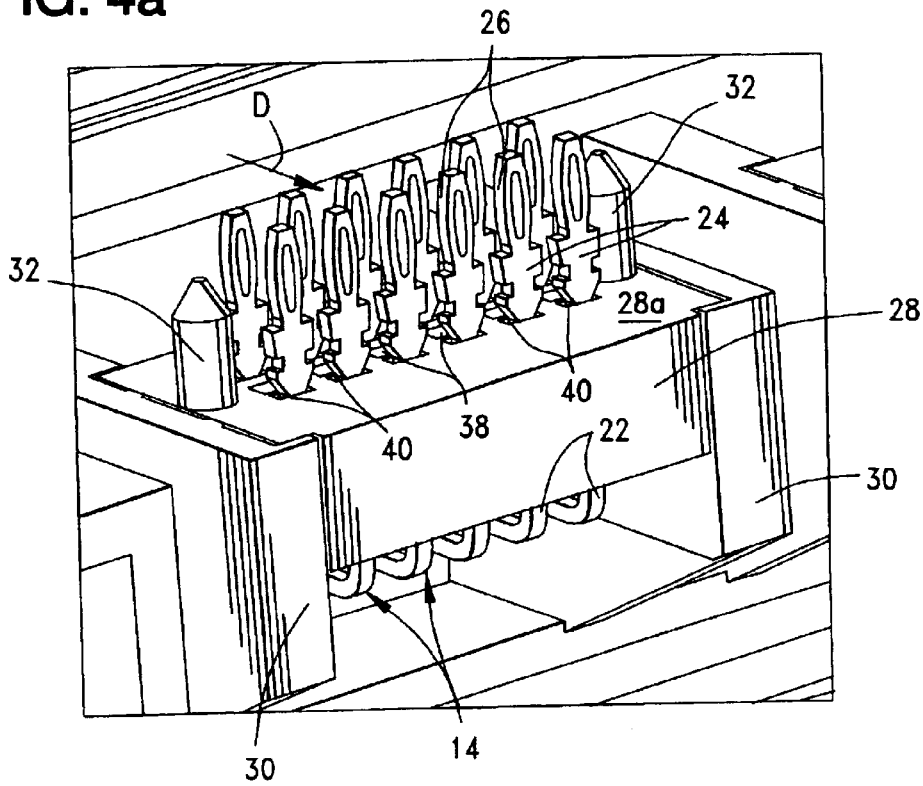
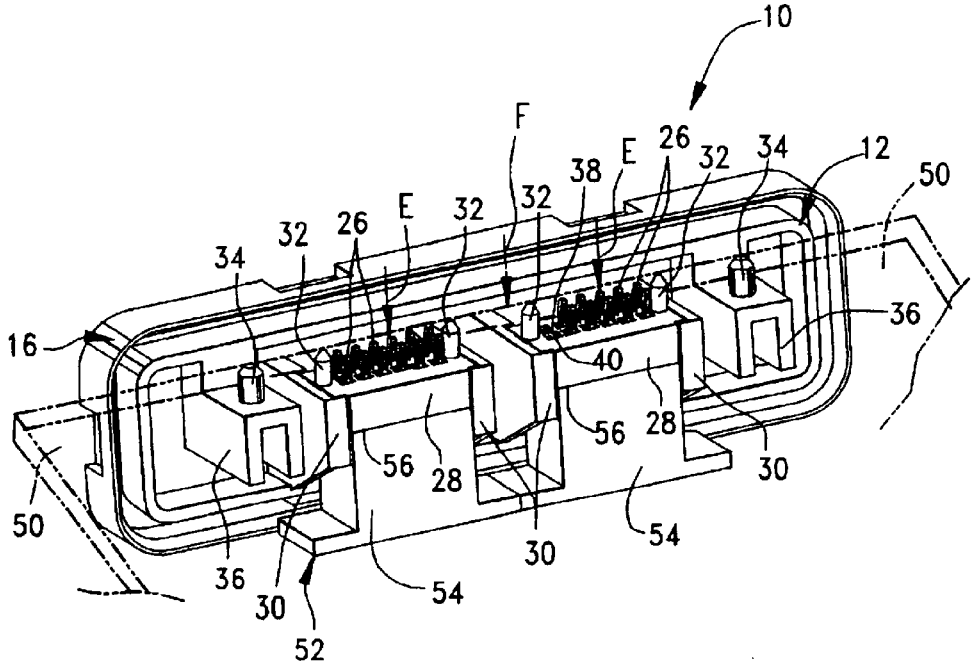
FIG. 5

FIG. 6
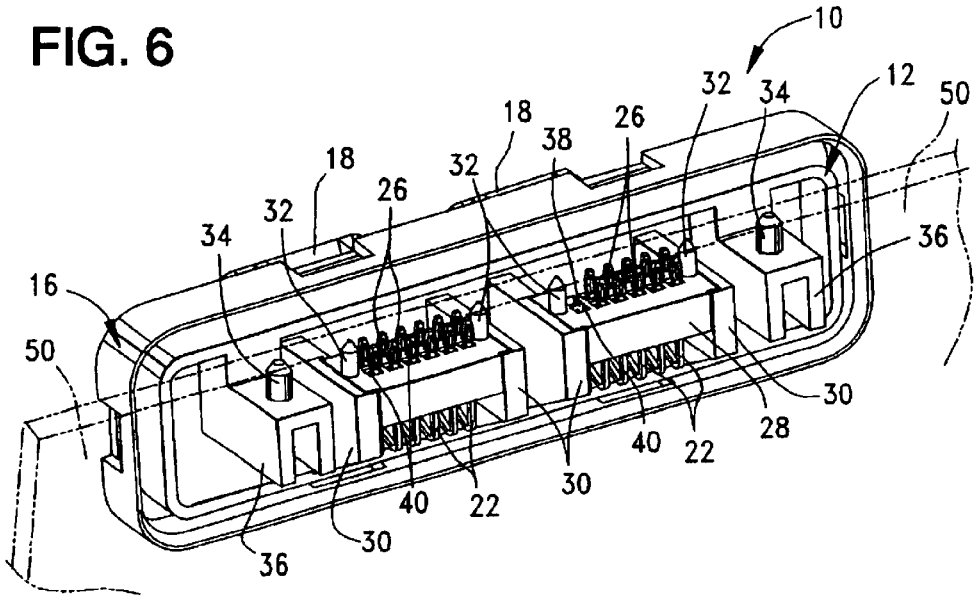
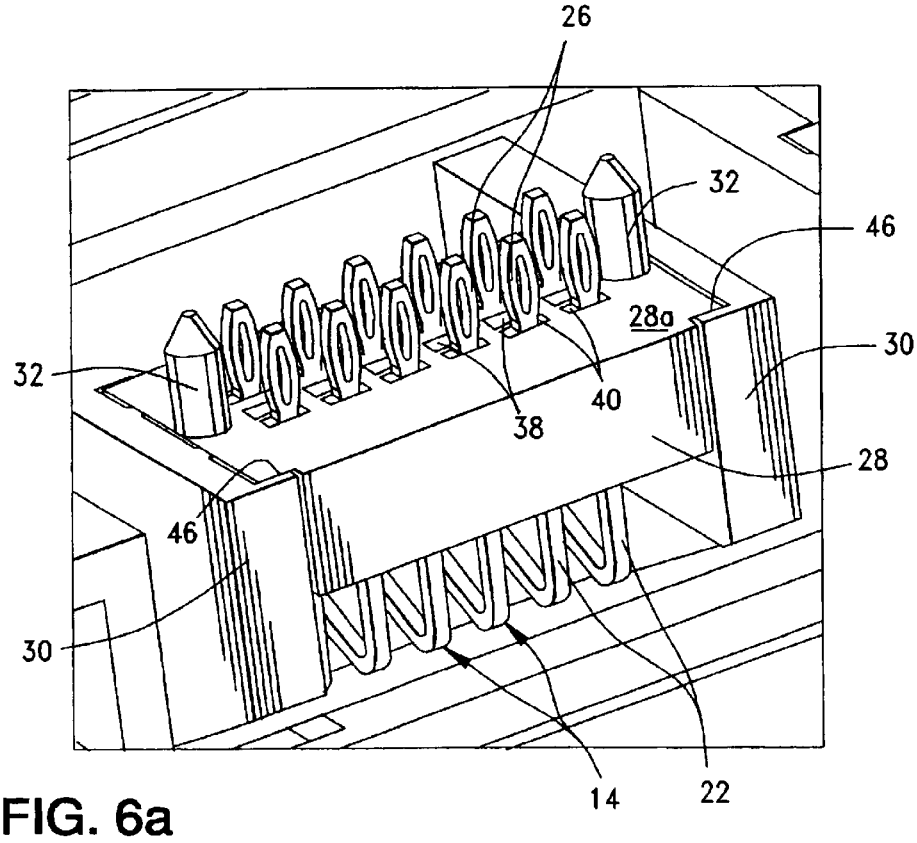
FIG. 6a

FIG. 7
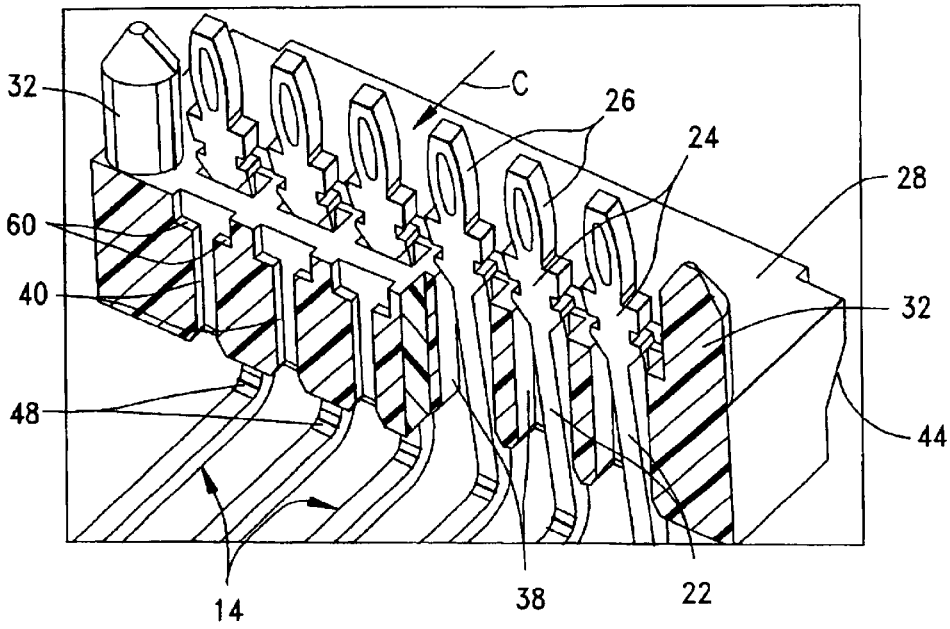
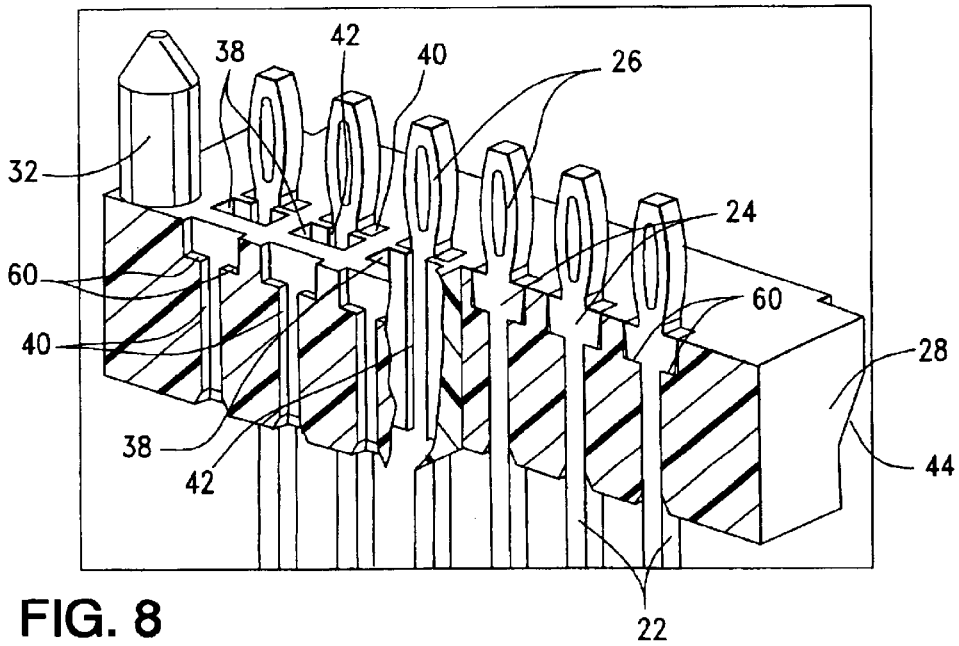
FIG. 8

ELECTRICAL CONNECTOR ASSEMBLY AND METHOD OF ASSEMBLING SAME

FIELD OF THE INVENTION

This invention generally relates to the art of electrical connectors, including a method of assembling a plurality of terminals in a connector housing and facilitating the termination of the terminals to a printed circuit board.

BACKGROUND OF THE INVENTION

Generally, a typical electrical connector includes some form of dielectric or insulating housing mounting a plurality of conductive terminals. For instance, the housing may be molded of plastic material and the terminals may be stamped and formed of sheet metal material. The housing has a plurality of terminal-receiving passages into which the terminals are inserted so that contact portions of the terminals are exposed for engaging the contact portions of the terminals of a complementary mating connector or other connecting device.

A typical electrical connector has a front mating end or face at which the contact portions of the terminals are exposed, and a rear terminating end or face at which terminating portions of the terminals are located. The terminal-receiving passages extend generally between the mating and terminating ends of the connector housing. The rear terminating portions of the terminals are connected to a variety of conductors ranging from discrete electrical wires to circuit traces on a printed circuit board.

A header connector is a connector of the type described above wherein the connector housing is adapted for use in conjunction with a printed circuit board. The terminals of a header connector typically are pin-type terminals or terminals which have pin portions for insertion into appropriate holes in the printed circuit board which typically is mounted at the rear terminating end or face of the connector housing. The terminal pins often are bent at right-angles for insertion into the circuit board, whereby the front mating end or face of the connector housing projects generally parallel to the circuit board. The terminal pins often are "compliant" pins whereby they are forced into the holes in the printed circuit board to establish an interference or press fit within the holes.

With the ever-increasing miniaturization of electrical connectors due to the ever-increasing density of the circuits in electronic applications, a myriad of problems have been encountered in fabricating and assembling electrical connectors as described above, such as header connectors having compliant pins for insertion into holes in a printed circuit board. To begin with, because of the miniaturization of the connector assembly, itself, the conductive terminals, such as stamped and formed sheet metal terminals, are extremely small, fragile and practically impossible to maintain at proper spacing or pitch. Consequently, pin alignment plates have been used for passing the terminal pins therethrough to maintain proper relative positioning of the terminal pins. If compliant pins are used, some form of mechanical support must be provided during assembly as the pins are forced into the holes in the printed circuit board. Still further, if the compliant pins are at right angles in an angled connector assembly, support of the terminal pins is difficult and unreliable. Typical alignment plates simply do not provide sufficient retention strength to force a large number of compliant pins into the holes of the printed circuit board. Therefore, support fixtures such as steel tooling must be used to support the alignment plate and compliant pins during assembly to the printed circuit board. This metal fixture typically looks like an elongated comb for insertion between rows of the terminal pins. Unfortunately, it is desirable in many applications to stagger the terminal pins in adjacent rows thereof. Consequently, such comb-like supporting fixtures cannot even be used because the staggered pins do not provide adequate passageways for the pin projections of the comb support.

This entire intertwined series of problems has made it extremely difficult to fabricate and/or assemble header connectors, such as right-angled header connectors and particularly connectors which use compliant pins which are assembled to printed circuit boards. The present invention is directed to a unique electrical connector and a method of assembling the connector to avoid or eliminate most if not all of these numerous problems.

SUMMARY OF THE INVENTION

An object, therefore, of the invention is to provide a new and improved electrical connector assembly of the character described.

Another object of the invention is to provide a unique method of assembling the electrical connector.

In the exemplary embodiment of the invention, the electrical connector includes a dielectric connector housing, a plurality of conductive terminals and a terminal support member. The housing and the support member may be molded of plastic material, and the terminals may be stamped and formed of conductive sheet metal material. The terminals are inserted into a plurality of terminal-receiving passages in the housing, with pin portions of the terminals projecting from the housing. The pin portions of the terminals are inserted in an insertion direction into a plurality of free passages in the terminal support member from one side thereof, until enlarged retention portions of the terminals pass retention sections of a plurality of retention passages in the support member. The retention passages are immediately adjacent the free passages and are connected thereto by communication openings therebetween. The pins portions then are moved transversely of the insertion direction through the communication openings and into alignment with the retention sections in the retention passages of the support member. The pin portions then can be moved opposite the insertion direction in the retention passages until the enlarged retention portions engage the retention sections of the retention passages.

According to one aspect of the invention, the pin portions of the terminals are biased by surfaces on the support member into alignment with the free passages as the pin portions are inserted thereinto. The pins portions, thereby, are sort of spring-loaded or "cocked" when inserted into the free passages. Consequently, movement of the pin portions transversely of the insertion direction from the free passages through the communication openings occurs automatically by self-resiliency of the terminals. This transverse movement of the pin portions occurs as the enlarged retention portions pass an opposite side of the support member. In a preferred assembly of the electrical connector, the terminal support member is moved relative to the connector housing to effect the insertion of the pin portions of the terminals into the free passages in the support member.

According to another aspect of the invention, the pin portions of the terminals are provided with compliant distal ends which are exposed at the opposite side of the support member. A printed circuit board is mounted to the compliant distal ends when the retention portions of the terminals are in engagement with the retention sections in the retention passages of the support member. A backing support, such as a metal fixture, is provided for the support member as the printed circuit board is mounted onto the compliant distal ends of the pin portions.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 2A is an enlarged perspective view of one of the terminal support blocks in the condition of FIG. 2;

FIG. 3 is a view similar to that of FIG. 2, with the support blocks moved so that the terminal pins move through the free passages in the support blocks;

FIG. 3A is an enlarged perspective view of one of the terminal support blocks in the condition of FIG. 3;

FIG. 4 is a view similar to that of FIGS. 2 and 3, with the terminal pins having moved transversely into the retention passages of the terminal support blocks;

FIG. 4A is an enlarged perspective view of one of the terminal support blocks in the condition of FIG. 4;

FIG. 5 is a view similar to that of FIGS. 2, 3 and 4, with the terminal support blocks being backed by a support fixture assembly, and with the terminal pins having been moved opposite their insertion direction into their final retained position within the terminal support blocks and ready for assembling a printed circuit board thereto;

FIG. 6 is a view similar to that of FIG. 5, with the support fixture assembly removed;

FIG. 6A is an enlarged perspective view of one of the terminal support blocks in the condition of FIG. 6;

FIG. 7 is a fragmented perspective view showing some of the terminal pins having been inserted through the free passages in one of the terminal support blocks;

FIG. 8 is a view similar to that of FIG. 7, with the terminal pins in their final retained position within the retention passages in the support block.

DETAILED DESCRIPTION OF THE PREFERRED EMBODIMENTS

Figures 1, 2:
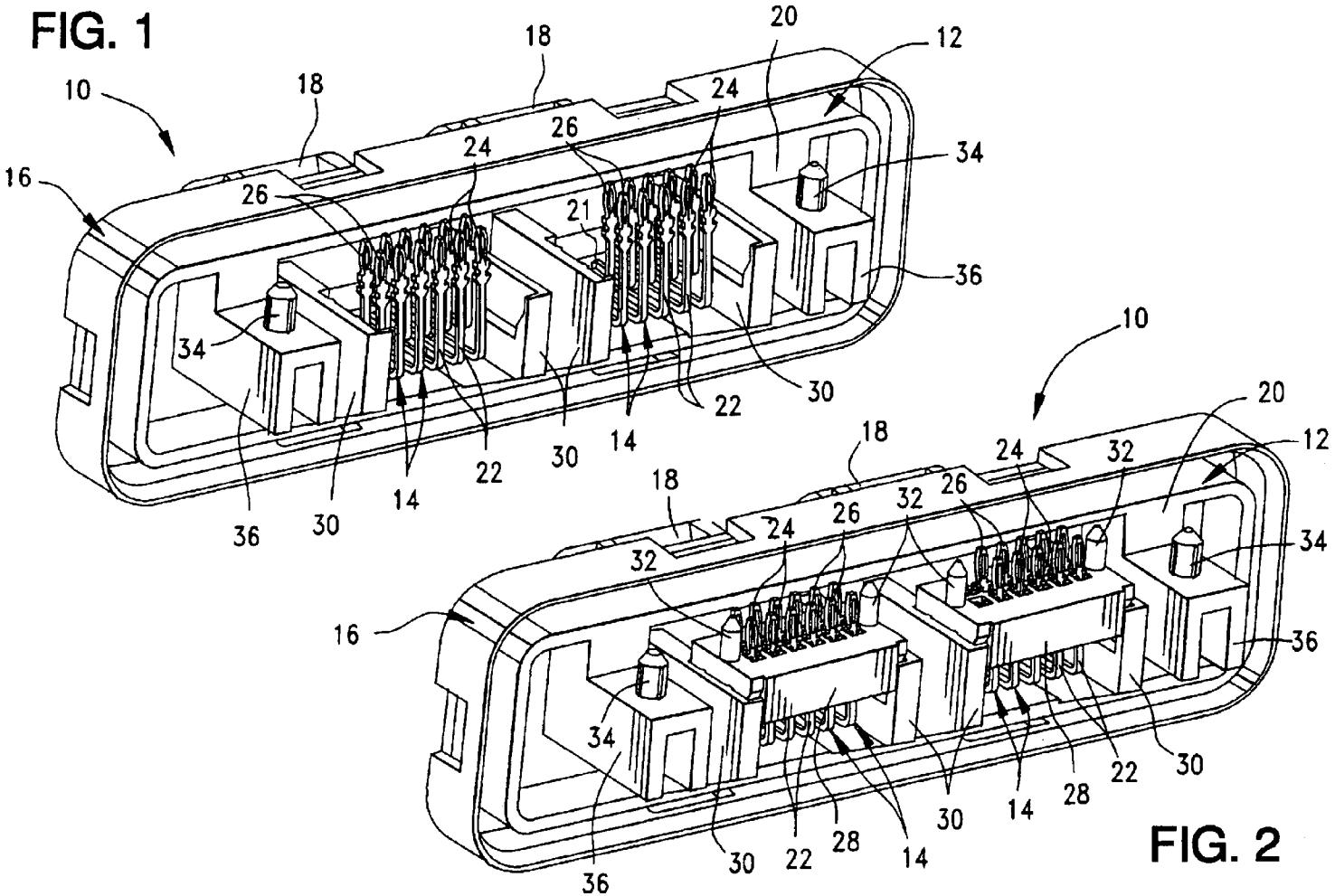
FIG. 1 is a rear perspective view of a header connector incorporating the concepts of the invention, with the terminal support blocks removed to show the angled configuration of the terminal pins.
FIG. 2 is a rear perspective view of a right-angled header connector embodying the concepts of the invention, with the terminal support blocks in an initial stage of being assembled over the terminal pins of the connector.

Referring to the drawings in greater detail, and first to FIG. 1, the invention is embodied in a typical header connector, generally designated 10, which includes a dielectric or insulating housing, generally designated 12, mounting a plurality of conductive terminals, generally designated 14. An EMI shield, generally designated 16, substantially surrounds the housing but leaves the rear end of the connector open as is clearly seen in FIG. 1. The housing may be molded of plastic material, and the terminals and the EMI shield 16 may be fabricated of stamped and formed sheet metal material. Housing 12 has a front mating end or face which really is not visible in the drawings. Suffice it to say, the housing and/or shield 16 define a pair of mating portions 18 within which contact portions of terminals 14 are disposed for engaging the contact portions of the terminals of one or two complementary mating connectors or other connecting devices. Housing 12 has a rear terminating end or face 20 which is clearly seen in FIG. 1. Terminals 14 are inserted through appropriate terminal-receiving passages 21 in the housing which extend in a direction between the mating and terminating ends of the housing. Header connector 10 is a right-angled connector and, consequently, terminals 14 are bent to form right-angled pin portions or terminal pins 22. Each terminal pin has an enlarged retention portion 24 and a compliant distal end 26. The distal ends are made compliant by providing an aperture therethrough which provides resilient sides of the distal ends at opposite sides of the apertures. As will be seen hereinafter, compliant distal ends 26 of terminal pins 22 are designed for insertion into appropriate holes in a printed circuit board to establish an interference or press fit therewithin. Finally, it can be seen in FIG. 1 that terminals 14 are arranged in two clusters corresponding to the two mating portions 18 projecting from the front mating end of the connector.

Referring to FIGS. 2 and 2A in conjunction with FIG. 1, a pair of terminal support members or blocks 28 are provided for the two clusters of terminals 14. The terminal support blocks may be molded of plastic material. Each terminal support block is supported between a pair of support ribs 30 formed integral with housing 12 and projecting rearwardly from rear face 20 thereof. Each terminal support block 28 has a pair of mounting posts 32 projecting upwardly therefrom for insertion into appropriate mounting holes in a printed circuit board (not shown). In addition, a pair of larger mounting posts 34 are rigidly supported by and project upwardly from a pair of support channels 36 located outside the entire array of terminals and the two terminal support blocks. Larger mounting posts 34 also are provided for insertion into appropriate mounting holes in the printed circuit board.

As seen best in the enlarged depiction of FIG. 2A, each terminal support block 28 has two rows of free passages 38 for receiving terminal pins 22 (including enlarged retention portions 24 and compliant distal ends 26) completely therethrough. Two rows of retention passages 40 are formed through terminal support block 28 immediately adjacent the two rows of free passages 38. Passages 38 are called "free" passages because terminal pins 22, enlarged portions 24 and compliant distal ends 26 can pass into and through the free passages without substantially any interference whatsoever. Passages 40 are called "retention" passages because, as will be seen hereinafter, retention shoulders or sections are provided therein for engaging the bottoms of enlarged portions 24 of the terminal pins. Elongated communication openings 42 are provided between free passages 38 and retention passages 40 to provide communication therebetween. Specifically, elongated communication openings 42 are wide enough for the passage therethrough of terminal pins 22 but narrow enough to prevent the passage therethrough of enlarged retention portions 24 of the terminal pins. As an alternative, the individual free passages can be replaced by a single, enlarged free passage area spanning the plurality of individual retention passages and in communication with the retention passages through the communication openings. In addition, each terminal support block 28 has a pair of angled cam surfaces 44 which engage a pair of cam abutment surfaces on support ribs 30.

In an initial step of assembly as depicted in FIGS. 2 and 2A, terminal pins 22 are inserted individually into free passages 38 (or the terminal pins are inserted collectively into a free passage area) of terminal blocks 28 by moving the terminal blocks downwardly in the direction of arrow "A" (FIG. 2A) so that compliant distal ends 26 of the terminal pins enter the bottoms of free passages 38. As the terminal support block is pushed downwardly in the direction of arrow "A", angled cam surfaces 44 on the support block engage cam abutment surfaces 46 on support ribs 30 to bias the support block inwardly or forwardly of the connector housing in the direction of arrow "B" (FIG. 2A). The result of this action is to spring-load or "cock" terminal pins 22 by bending the terminal pins inwardly or forwardly in the direction of arrow "B" about the elbows 48 of the right-angled terminals 14.

FIGS. 3 and 3A show terminal support blocks 28 having been moved completely downwardly in the direction of arrow "A" and inwardly in the direction of arrow "B" until terminal pins 22 are completely "cocked" and the enlarged retention portions 24 of the terminal pins have cleared a top surface 28*a* (FIG. 3A) of the terminal block. This action effectively moves enlarged retention portions 24 upwardly and beyond communication openings 42 which communicate between free passages 38 and retention passages 40. In other words, the terminal pin portions have been "cocked" rearwardly in the direction of arrow "C" (FIG. 3A) until enlarged retention portions 24 pass completely through and out of the tops of free passages 38.

When enlarged portions 24 of terminal pins 22 reach the positions shown in FIGS. 3 and 3A and as described above, the cocked terminal pins snap back rearwardly or outwardly from their cocked positions in the direction of arrow "D" (FIG. 4A) to positions shown in FIGS. 4 and 4A. The terminal pins now are located in retention passages 40. This movement occurs automatically because of the self-resiliency stored in the cocked or bent metal terminal pins. During movement from the free passages to the retention passages, narrow terminal pins 22 below enlarged retention portions 24 pass freely through elongated communication openings 42 between the free passages and the retention passages. In essence, the terminal pins move automatically in a direction transversely of their insertion direction into the terminal support blocks.

The next step in the assembly method is to move the terminal pins within retention passages 40 opposite their insertion direction into free passages 28, until the terminal pins are supported within the retention passages. In other words, the terminal pins are moved downwardly in the direction of arrows "E" (FIG. 5) to their final retained and supported position shown in FIGS. 5 and 6. In order to effect this reverse movement of the terminal pins, an appropriate flat tool (not shown) is positioned on top of compliant distal ends 26 of the terminal pins and the pins are pushed downwardly in the direction of arrows "E" until enlarged portions 24 of the terminal pins engage retention shoulders (described hereinafter) within retention passages 40. The flat tool or fixture for moving the terminal pins downwardly is not shown in FIG. 5, because its depiction would block out the positions of the terminal pins.

Header connector 10, with terminal pins 22 supported within terminal support blocks 28, now is ready to be assembled to a printed circuit board shown in phantom at 50 in FIG. 5. The printed circuit board cannot be shown in full lines or else it would completely block out the depiction of the other components of the connector. However, it should be understood that installing the printed circuit board requires forcing compliant distal ends 26 of the terminal pins into holes in the printed circuit board by an interference or press fit. This requires a large force because of the number of terminal pins involved, and the forces could damage plastic terminal support blocks 28. Consequently, a support fixture assembly, generally designated 52, is provided with a pair of support tools 54 which can be placed on a support surface and provide a backing against the bottom surface 56 of the support blocks. Therefore, printed circuit board 50 can be pushed downwardly in the direction of phantom arrow "F" onto compliant distal ends 26 with considerable force as support tools 54 provide the necessary backing support for terminal support blocks 28. During assembly of the printed circuit board, mounting posts 32 projecting upwardly from the terminal support blocks and mounting posts 34 projecting upwardly from support channels 36 are forced into appropriate mounting holes in the printed circuit board. FIG. 6 shows support fixture assembly 52 and support tools 54 removed to leave printed circuit board 50 fully assembled to header connector 10.

FIG. 7 shows a section through one of the terminal support blocks 28 to show that free passages 38 are totally unencumbered to allow the free passage therethrough of terminal pins 22 along with enlarged retention portions 24 and compliant distal ends 26 of the terminal pins. The depiction in FIG. 7 corresponds approximately to the relative positioning of the terminal pins shown in FIGS. 3 and 3A, except that enlarged portions 24 have not quite cleared the tops of the free passages in FIG. 7. It also can be seen in FIG. 7 how the terminal pins have been cocked or spring-loaded in the direction of arrow "C" by bending terminals pins 22 about elbows 48 of the terminal pins.

Both FIGS. 7 and 8 show the configurations of retention passages 40 which include retention sections defined by a pair of retention shoulders 60 located on opposite sides of each passage. FIG. 8 shows enlarged retention portions 24 of three terminal pins 22 in abutment with the respective retention shoulders 60. The relative positions of the terminal pins correspond substantially to that shown in FIGS. 5–6A. FIG. 8 also shows one of the elongated communication openings 42 which communicates between free passages 38 and retention passages 40. This shows that the communication openings prevent the enlarged retention portions of the terminal pins to move between the free passages and the retention passages, but the elongated communication openings allow terminal pins 22 to pass therethrough from the free passages to the retention passages when the terminal pins reach their positions shown in FIGS. 3 and 3A.

Figure 9:
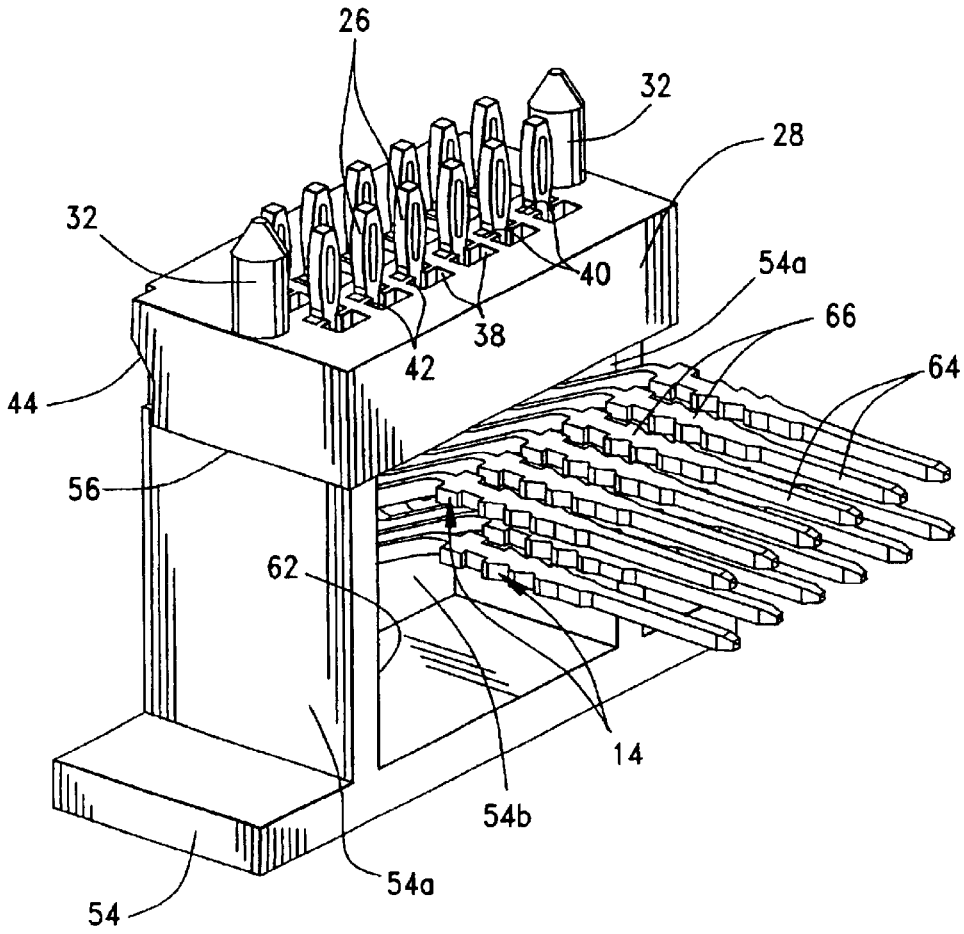
FIG. 9 is a perspective view of the inside of one of the support tools shown in FIG. 5, with the connector housing removed to facilitate the illustration.

Finally, FIG. 9 shows the construction of one of the support tools 54 on the back side thereof in comparison to the depiction of FIG. 5. Support tool 54 is generally hollow, as at 62, to accommodate the cluster of terminal pins 14 therewithin. The metal support tool has upstanding side walls 54*a* along with its front wall 54*b* for abutting against the bottom surface 56 of terminal support block 28. With this structure, the terminal pins can be oriented in "staggered" rows wherein the terminal pins in one row are staggered or offset relative to the pins in the other row. FIG. 9 actually is not a realistic depiction, because connector housing 12 (FIG. 5) has been removed which would not actually happen during assembly. Nevertheless, this has been done to show the inside of one of the support tools and the complete configuration of terminals 14 which include contact portions 64 and contact retention portions 66. Contact portions 64 project into mating portions 18 (FIG. 1) of the connector, while retention portions 66 retain the terminals within the terminal-receiving passages 21 of housing 12.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A method of assembling an electrical connector, comprising the steps of:

providing a dielectric connector housing with a plurality of terminal-receiving passages;

providing a plurality of conductive terminals with pin portions having enlarged retention portions spaced inwardly from distal ends of the pin portions;

inserting the terminals into the terminal-receiving passages of the housing with said pin portions projecting therefrom;

providing a dielectric terminal support member with a plurality of pairs of through passages, one through passage in each pair thereof comprising a free passage through which the terminal pins can freely pass, the other through passage in each pair thereof comprising a retention passage with retention means therein, and a communication opening between the through passages in each pair thereof;

inserting the pin portions of the terminals in an insertion direction into the free passages in the support member from one side thereof until the enlarged retention portions pass the retention means of the retention passages in the support member;

moving the pin portions of the terminals transversely of said insertion direction through said communication openings and into the retention passages in the support member; and moving the pin portions of the terminals opposite said insertion direction in the retention passages until the retention portions of the pin portions engage the retention means in the retention passages.

2. The method of claim 1 wherein the pin portions of the terminals are inserted into the free passages in said insertion direction until said enlarged retention portions pass an opposite side of the support member.

3. The method of claim 1 wherein said pin portions of the terminals are biased by the housing into alignment with said free passages as the pin portions are inserted thereinto.

4. The method of claim 3 wherein said movement of the pin portions of the terminals transversely of said insertion direction from the free passages through said communication openings and into the retention passages occurs automatically by self-resiliency of the terminals.

5. The method of claim 1 wherein said terminal support member is moved relatively to the connector housing to effect said insertion of the pin portions of the terminals into the free passages in the support member.

6. The method of claim 1, including providing the pin portions of said conductive terminals with compliant distal ends, and mounting a printed circuit board onto the distal ends when the retention portions of the pin portions are in engagement with the retention means in the retention passages of the support member.

7. The method of claim 6, including providing a backing support for the support member as the printed circuit board is mounted onto the distal ends of the pin portions.

8. The method of claim 1 wherein said dielectric connector housing is configured to provide a right-angled electrical connector, and the pin portions of the terminals correspondingly are bent at right-angles after the terminals are inserted into the terminal-receiving passages of the housing.

9. The method of claim 1 wherein said distal ends of the pin portions are provided as compliant distal ends for forcible insertion into appropriate holes in a printed circuit board.

10. A method of assembling an electrical connector which includes a dielectric connector housing, a plurality of conductive terminals and a terminal support member, comprising the steps of:

inserting the terminals into a plurality of terminal-receiving passages in the housing with pin portions of the terminals projecting from the housing;

inserting the pin portions of the terminals in an insertion direction into a plurality of free passages in the support member from one side thereof until retention portions of the terminals pass retention sections of a plurality of retention passages in the support member; and moving the pin portions of the terminals transversely of said insertion direction through a plurality of communication openings in the support member from the free passages, into the retention passages and into alignment with the retention sections in the retention passages in the support member.

11. The method of claim 10, including the step of moving the pin portions of the terminals opposite said insertion direction in the retention passages until the retention portions of the pin portions engage the retention sections in the retention passages.

12. The method of claim 11, including providing the pin portions of said conductive terminals with compliant distal ends, and mounting a printed circuit board onto the distal ends when the retention portions of the pin portions are in engagement with the retention sections in the retention passages of the support member.

13. The method of claim 12, including providing a backing support for the support member as the printed circuit board is mounted onto the distal ends of the pin portions.

14. The method of claim 10 wherein the pin portions of the terminals are inserted into the free passages in said insertion direction until said retention portions pass an opposite side of the support member.

15. The method of claim 10 wherein said pin portions of the terminals are biased by the housing into alignment with said free passages as the pin portions are inserted thereinto.

16. The method of claim 15 wherein said movement of the pin portions of the terminals transversely of said insertion direction from the free passages through said communication openings and into the retention passages occurs automatically by self-resiliency of the terminals.

17. The method of claim 10 wherein said terminal support member is moved relatively to the connector housing to effect said insertion of the pin portions of the terminals into the free passages in the support member.

18. The method of claim 10 wherein said dielectric connector housing is configured to provide a right-angled electrical connector, and the pin portions of the terminals correspondingly are bent at right-angles after the terminals are inserted into the terminal-receiving passages of the housing.

19. The method of claim 10 wherein said distal ends of the pin portions are provided as compliant distal ends for forcible insertion into appropriate holes in a printed circuit board.

20. A method of assembling an electrical connector which includes a dielectric connector housing, a plurality of conductive terminals and a terminal support member, comprising the steps of:

inserting the terminals into a plurality of terminal-receiving passages in the housing with pin portions of the terminals projecting from the housing;

inserting the pin portions of the terminals in an insertion direction into a free passage area in the support member from one side thereof until retention portions of the terminals pass retention sections of a plurality of retention passages in the support member; and moving the pin portions of the terminals transversely of said insertion direction through a plurality of communication openings in the support member from the free passage area, into the retention passages and into alignment with the retention sections in the retention passages in the support member.

21. The method of claim 20, including the step of moving the pin portions of the terminals opposite said insertion direction in the retention passages until the retention portions of the pin portions engage the retention sections in the retention passages.

22. The method of claim 21, including providing the pin portions of said conductive terminals with compliant distal ends, and mounting a printed circuit board onto the distal ends when the retention portions of the pin portions are in engagement with the retention sections in the retention passages of the support member.

23. The method of claim 22, including providing a backing support for the support member as the printed circuit board is mounted onto the distal ends of the pin portions.

24. The method of claim 20 wherein the pin portions of the terminals are inserted into the free passage area in said insertion direction until said retention portions pass an opposite side of the support member.

25. The method of claim 20 wherein said pin portions of the terminals are biased by the housing into alignment with said free passage area as the pin portions are inserted thereinto.

26. The method of claim 25 wherein said movement of the pin portions of the terminals transversely of said insertion direction from the free passage area through said communication openings and into the retention passages occurs automatically by self-resiliency of the terminals.

27. The method of claim 20 wherein said terminal support member is moved relatively to the connector housing to effect said insertion of the pin portions of the terminals into the free passage area in the support member.

28. The method of claim 20 wherein said dielectric connector housing is configured to provide a right-angled electrical connector, and the pin portions of the terminals correspondingly are bent at right-angles after the terminals are inserted into the terminal-receiving passages of the housing.

29. The method of claim 20 wherein said distal ends of the pin portions are provided as compliant distal ends for forcible insertion into appropriate holes in a printed circuit board.

* * * * *